US006244305B1

(12) United States Patent
Calmerklint et al.

(10) Patent No.: US 6,244,305 B1
(45) Date of Patent: Jun. 12, 2001

(54) REFLECTED LIGHT TYPE WEFT MONITORING DEVICE

(75) Inventors: Roland Calmerklint, Älmhult; Karl-Gustav Pettersson, Urshult, both of (SE)

(73) Assignee: Eltex of Sweden AB, Almhut (SE)

( * ) Notice: Subject to any disclaimer, the term of this patent is extended or adjusted under 35 U.S.C. 154(b) by 0 days.

(21) Appl. No.: 09/530,780

(22) PCT Filed: Nov. 19, 1998

(86) PCT No.: PCT/SE98/02086

§ 371 Date: May 5, 2000

§ 102(e) Date: May 5, 2000

(87) PCT Pub. No.: WO99/27172

PCT Pub. Date: Jun. 3, 1999

(30) Foreign Application Priority Data

Nov. 24, 1997 (SE) ..... 9704313

(51) Int. Cl.[7] ..... D03D 51/34

(52) U.S. Cl. ..... 139/370.2; 250/559.01; 356/430

(58) Field of Search ..... 139/370.2; 242/534.1; 250/559.01; 356/430

(56) References Cited

U.S. PATENT DOCUMENTS 4,738,284 * 4/1988 Ishikawa ..... 139/370.2
5,479,965 * 1/1996 Rydborn ..... 139/370.2
5,694,979 * 12/1997 Toda ..... 139/370.2

* cited by examiner

*Primary Examiner*—Andy Falik
(74) *Attorney, Agent, or Firm*—Antonelli, Terry, Stout & Kraus, LLP

(57) ABSTRACT

A device for monitoring a thread, for example the weft thread in a loom of the type in which the weft is driven through the shed of the loom with the aid of a jet, such as a gas jet, for example an air jet, and which has a reed with a longitudinal channel for the weft. An arm with a free end is placed in a position at which it is desirable to monitor the weft. The arm free end has at least one light source for illuminating the monitoring point and any weft located there. A number of light-sensitive elements on the arm free end are aimed towards the channel of the reed to sense the light reflected therefrom. Each light sensitive element generates an electric signal corresponding to the reflected light and is connected to an evaluator circuit for adding the signals regardless of whether the weft at the monitoring point results in an increase or a reduction of the signals obtained from the light-sensitive elements, to generate a signal corresponding to the absolute value of the signals.

10 Claims, 9 Drawing Sheets

P12V
c PL3
e PL4
8
R2 100k
X
R13 470
6
5
7
IC1 TI C272
R5 560
R6 560
14 BC 857
13 BC 857
C2 100pF
R8 100
PL2 OUTPUT PI3-2
X R14

P12V
c PL1
e PL5
9
R1 100k
X
R12 470
2
3
1
IC1 ILC 272
R3 560
R4 560
T1 BC 857
T2 BC 857
C1 100pF
B7 1k
PL11 OUTPUT PI4-2
X R11

IC1 TL C272
P12V
0
4
C3 33nF x R10, R11 AND R12 SET AFTER TESTING
P12V
+12V DC PL10
PL6
LED CURRENT
PL7
GND
PL8
PL9
R-LED

| | | |
|---|---|---|
| FIG. 12A | FIG. 12B | FIG. 12C |
| FIG. 12D | FIG. 12E | FIG. 12F |

REFLECTED LIGHT TYPE WEFT MONITORING DEVICE

FIELD OF THE INVENTION

The present invention relates to a device for monitoring of a thread, for example the weft thread in a loom of substantially the type in which the weft is driven through the shed of the loom with the aid of a jet, such as a gas jet, for example an air jet, and which has a reed with a longitudinal channel for the weft and an arm with a free end in a position at which it is desirable to monitor the arm weft, the free end having at least one light source for illuminating the monitoring point and possibly the weft located there, and a number of light-sensitive elements.

BACKGROUND OF THE INVENTION

Prior art arrival-indicators function unreliably, often resulting in many erroneous triggerings, as well as many actual fault triggering situations which remain undetected. These problems are particularly accentuated in air-driven looms, so-called jet looms, which are extraordinarily rapid and which operate at such high speeds as 20 picks per second, in which event the arrival sensing must be executed under approximately 10–15° of a whole machine cycle (5% of the cycle). This naturally places extremely high demands on the indicator proper and its associated electronics, in particular as regards sensitivity and speed. Moreover, prior art indicators with whose help a part of the above-outlined problems have been reduced or even wholly obviated have proved to be extremely uneven in connection with different weft yarns, which may reflect light to different extents. The problems have been accentuated in the employment of weft yarns with different colors and structures. In certain contexts, the problems have proved to be so intractable that no signals have been emitted at all on the use of certain weft threads or weft yarns.

SUMMARY OF THE INVENTION

The object of the present invention is to improve the indicators and, to such a high degree as is possible, to obviate or at least reduce the sensitivity to different weft yarns or weft threads, both as regards color and structure.

This object is solved according to the present invention in that the device of the invention is characterized in that the light-sensitive elements are each aimed in a direction towards the channel for sensing the light reflected from an illuminated area to generate an electric signal corresponding to the reflected light, and are each connected to an evaluator circuit for adding the signals regardless of whether the weft occurring in the monitoring point entails an increase or reduction of the signals obtained from the light-sensitive elements. The illumination of the monitoring point is pulsed to generate a carrier wave with an average amplitude which represents the reflection of light from the channel in the reed and which changes on the occurrence of the weft. The light source and the light-sensitive elements are focused substantially on a line which extends transversely of the channel in the reed. The evaluation circuit includes one channel for each light-sensitive element and electronic circuit elements which are programmed to treat the signals from the channels, and thereby the light-sensitive, as absolute value.

The present invention provides a monitoring device which may be employed with great reliability in the most rapid jet looms or air-driven looms in that the weft thread is sensed with great dependability regardless of structure or colour. A device according to the present invention is moreover relatively independent of where in the channel the monitored thread is located. A monitoring device according to the present invention moreover obviates the majority of drawbacks inherent in prior art designs and constructions.

BRIEF DESCRIPTION OF THE DRAWINGS

The present invention will be described in greater detail hereinbelow with reference to the accompanying drawings.

DETAILED DESCRIPTION

Figure 1:
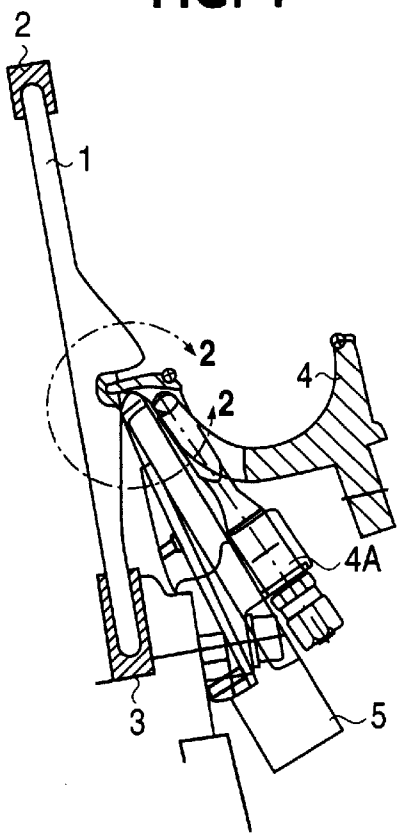
FIG. 1 is a cross section through parts of a reed including a device according to the present invention.
Figure 2:
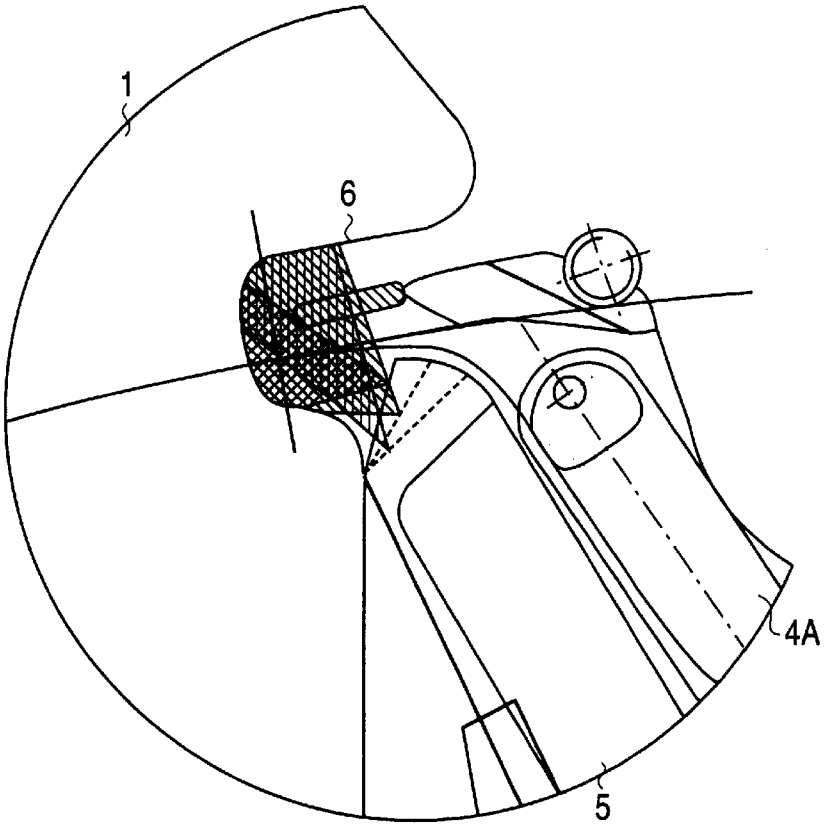
FIG. 2 shows, on a larger scale, the encircled portion 2—2 of FIG. 1.
Figure 2:
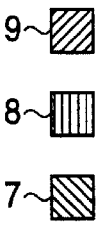
Figure 5:
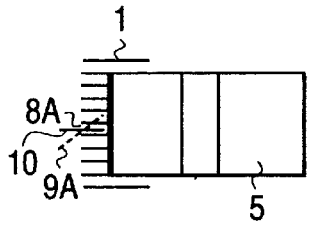
FIG. 5 shows the part illustrated in FIGS. 3 and 4 from beneath.
Figure 3:
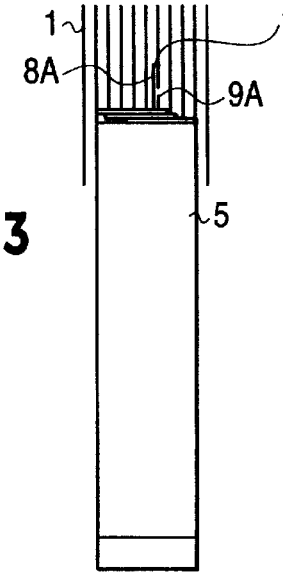
FIG. 3 shows a part of a device according to the present invention from the rear.
Figure 4:
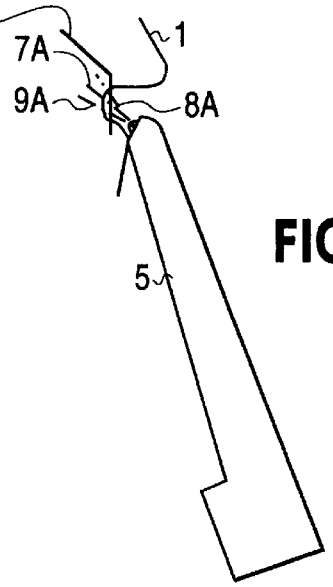
FIG. 4 shows the part according to FIG. 3 seen from the side.
Figure 6:
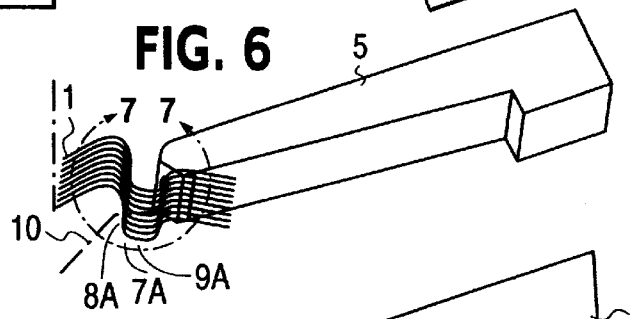
FIG. 6 is a perspective view of the part illustrated in FIGS. 3–5.
Figure 7:
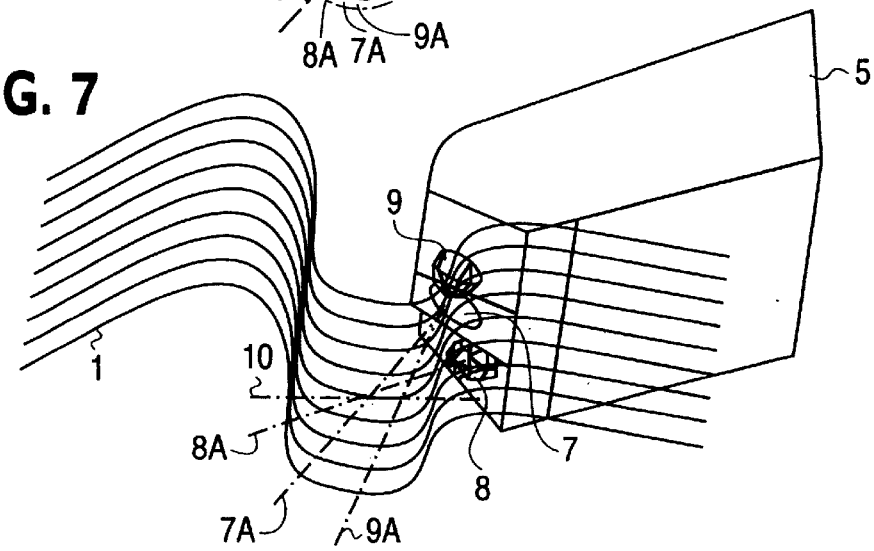
FIG. 7 shows, on a larger scale, the encircled portion 7—7 in FIG. 6.

FIGS. 1 and 2 show parts of a reed which includes a large number of lamellae 1 disposed in spaced apart relationship and extending between an upper rail 2 and a lower rail 3. The sectioned part 4 and the nozzle 4A are included in the loom. The part 4 serves for guiding the gas jet generated by means of a large number of nozzles 4A placed in spaced apart relationship. In this embodiment of a device according to the present invention, an arm 5 has a free end in the proximity of the channel 6 of the reed. At the free end of the arm 5, there is disposed an LED 7 for illuminating the reed channel. The light direction of the LED 7 is illustrated by line 7A in FIGS. 4, 6 and 7. The free end of the arm 5 moreover displays a light-sensitive element 8 in the form of a photo transistor for sensing reflection from the upper region of the reed channel. The element 8 is directed as illustrated by line 8A in FIGS. 4–7. Further, the free end of the arm 5 has a light-sensitive element 9 for sensing reflection from the lower region of the reed channel and also consists of a photo transistor. The element 9 is directed as illustrated by line 9A in FIGS. 4–7. Both the LED 7 and the photo transistors 8 and 9 are focused on a line 10 which extends transversely of the reed channel 6. The directions are illustrated in FIG. 2 by elements 7, 8, and 9. This may also be expressed such that the elements 8 and 9 are directed at different angles to the channel 6 illuminated by means of the LED 7.

Figures 8, 9, 10, 11:
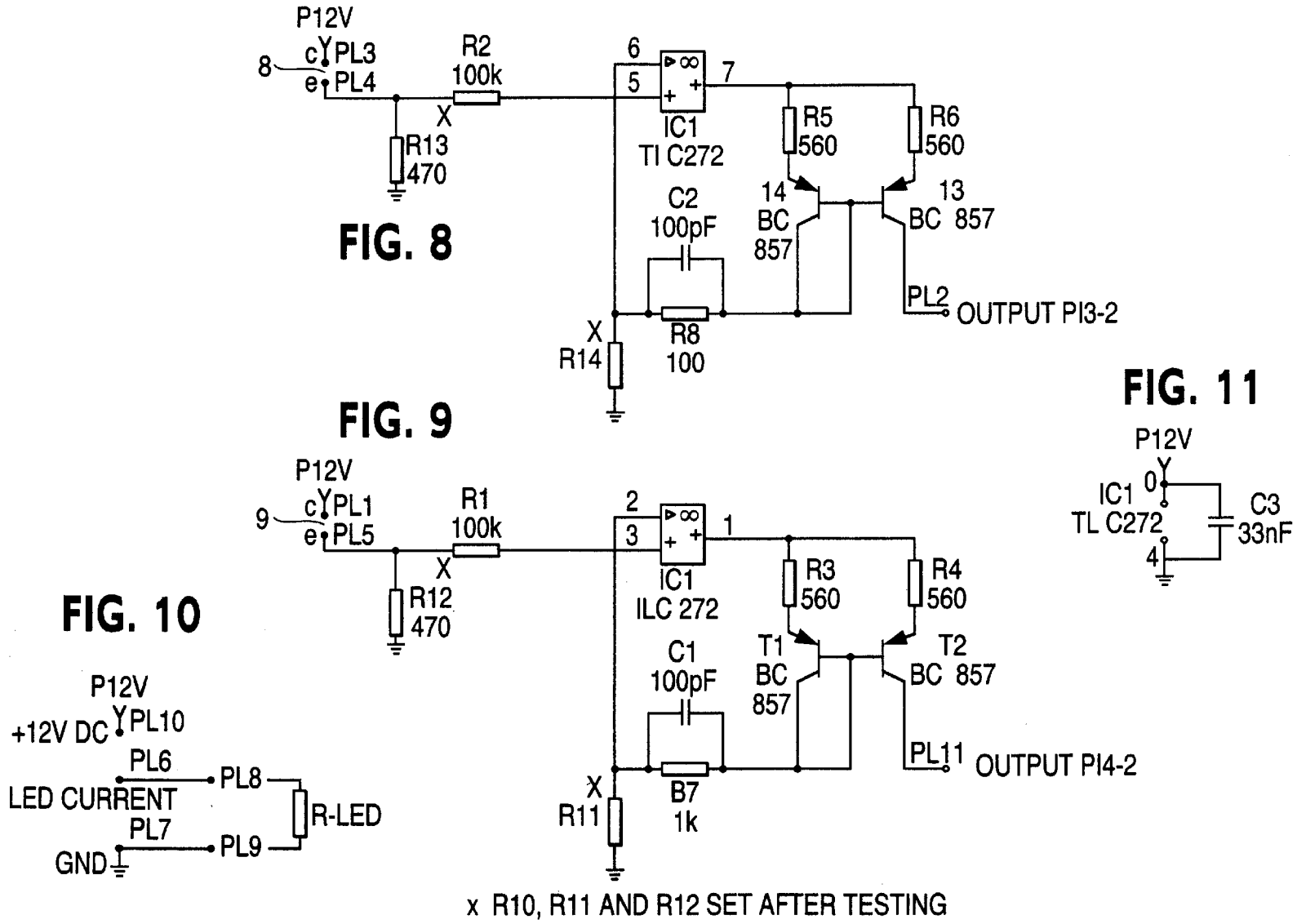
FIG. 8 shows an electronic circuit for a first channel in a device according to the present invention.
FIG. 9 shows an electronic circuit for a second channel in a device according to the present invention.
FIG. 10 shows an illumination circuit in a device according to the present invention.
FIG. 11 shows a circuit for powering parts of the circuits in the device according to the present invention.
Figures 12, 12A:
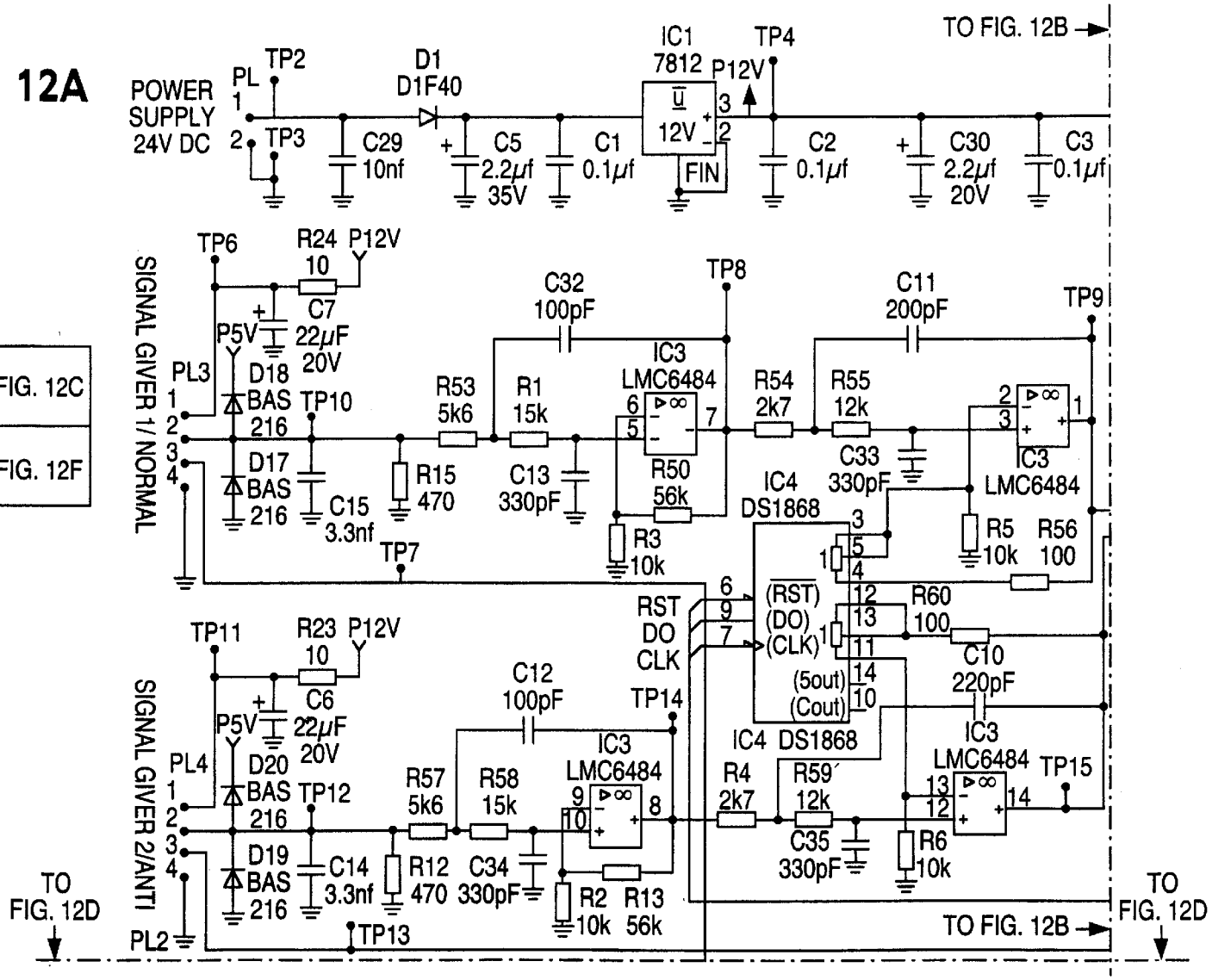
FIGS. 12A–12F when positioned as shown in FIG. 12, show a coupling diagram of a circuit for evaluating and of the signals from the device according to the present invention.
Figure 12B:
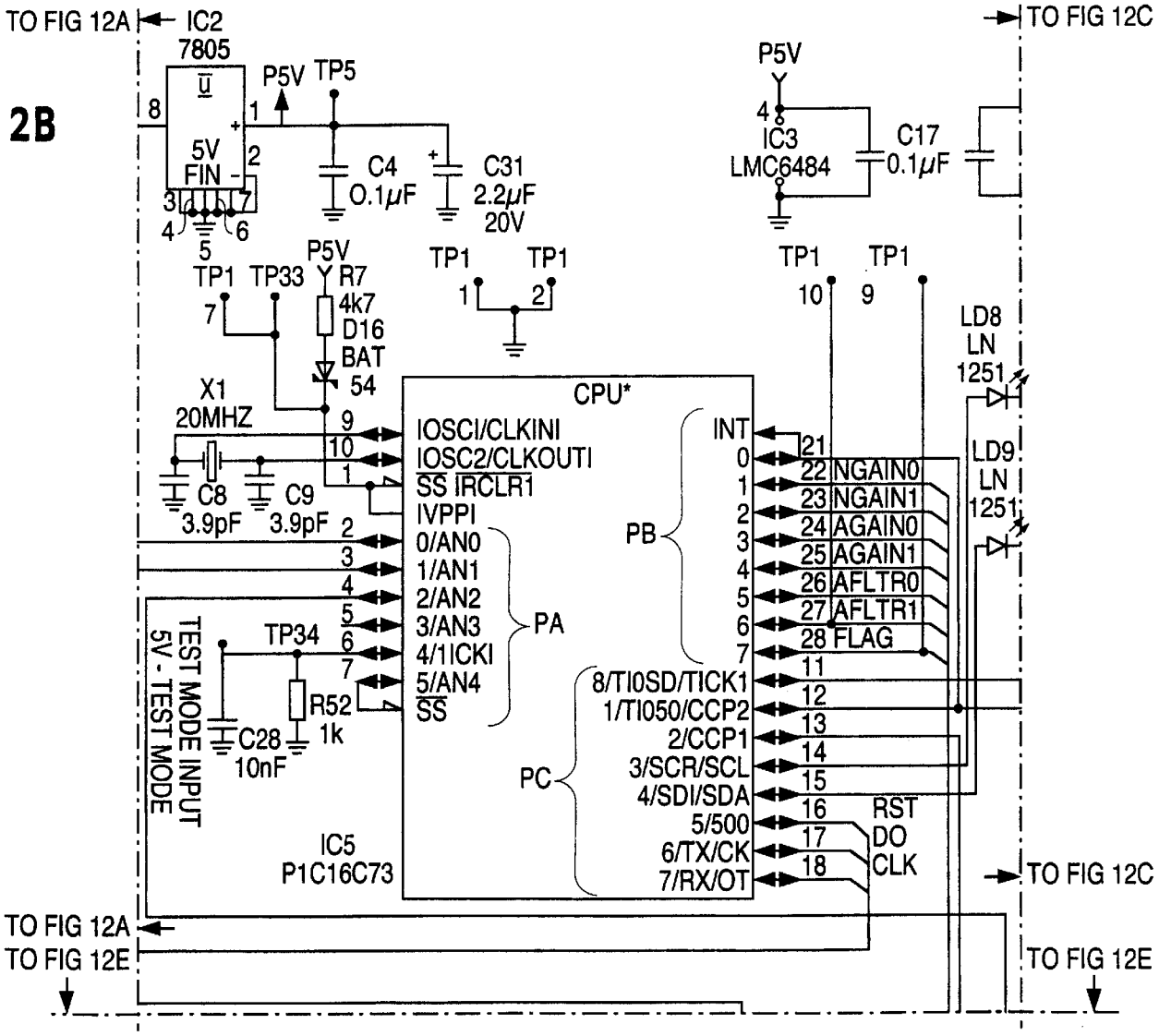
Figure 12C:
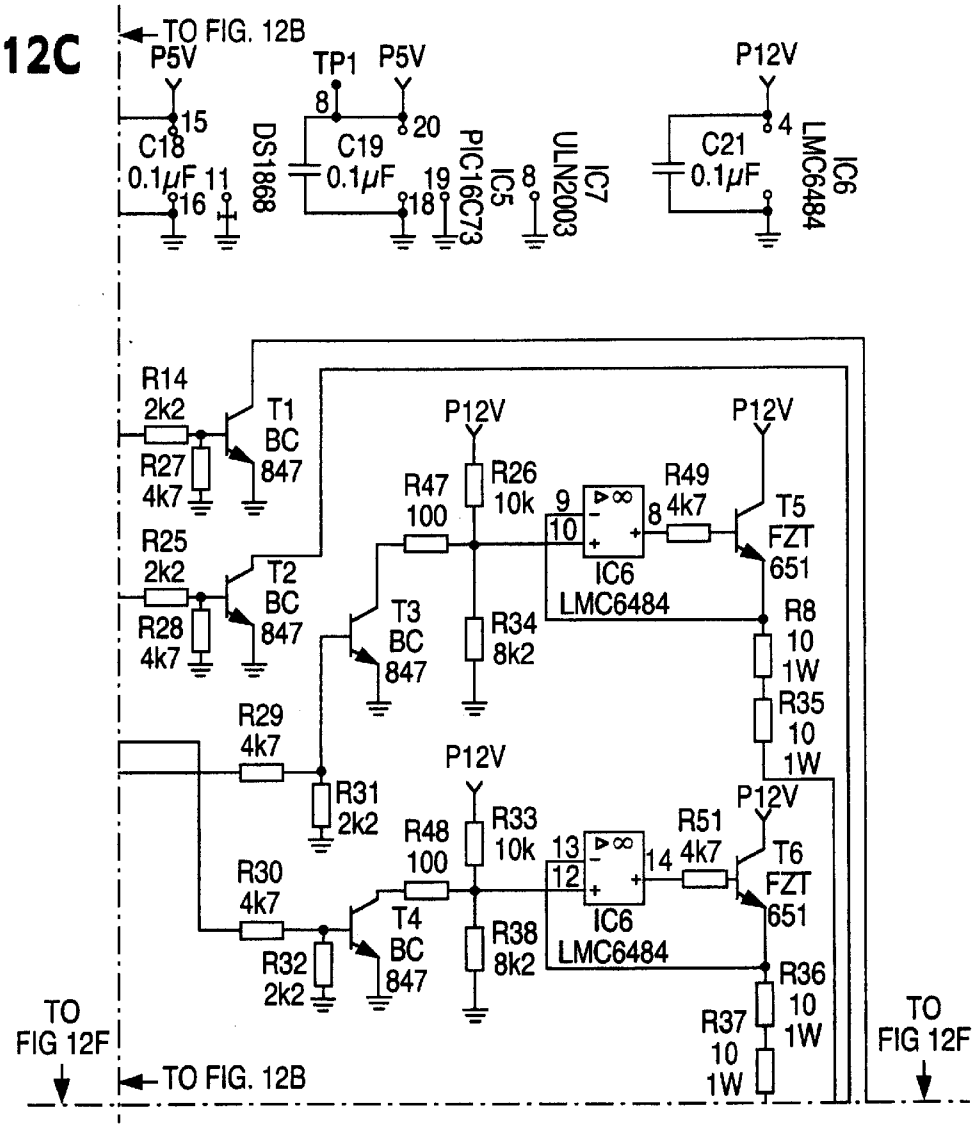
Figure 12D:
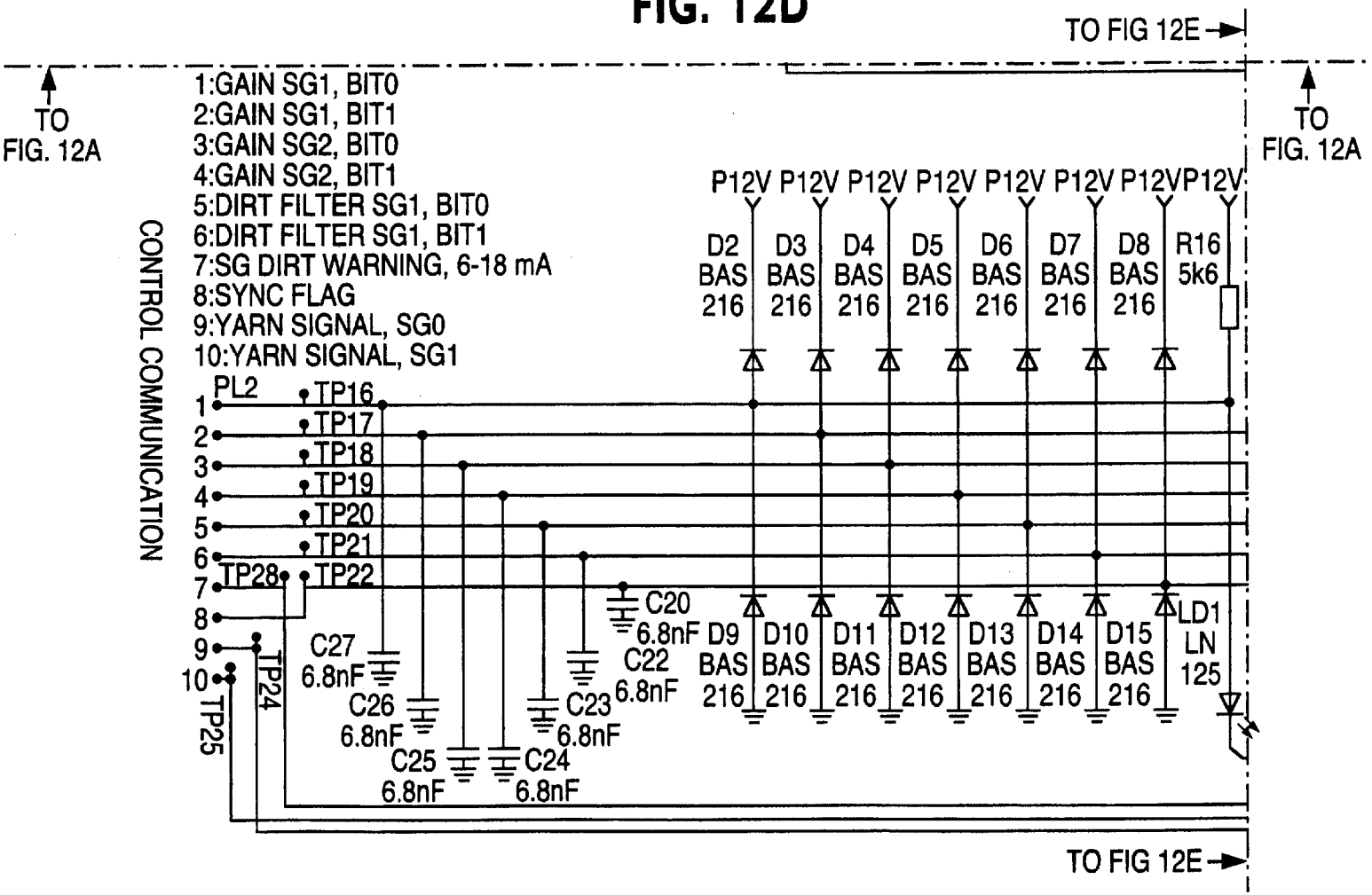
Figure 12E:
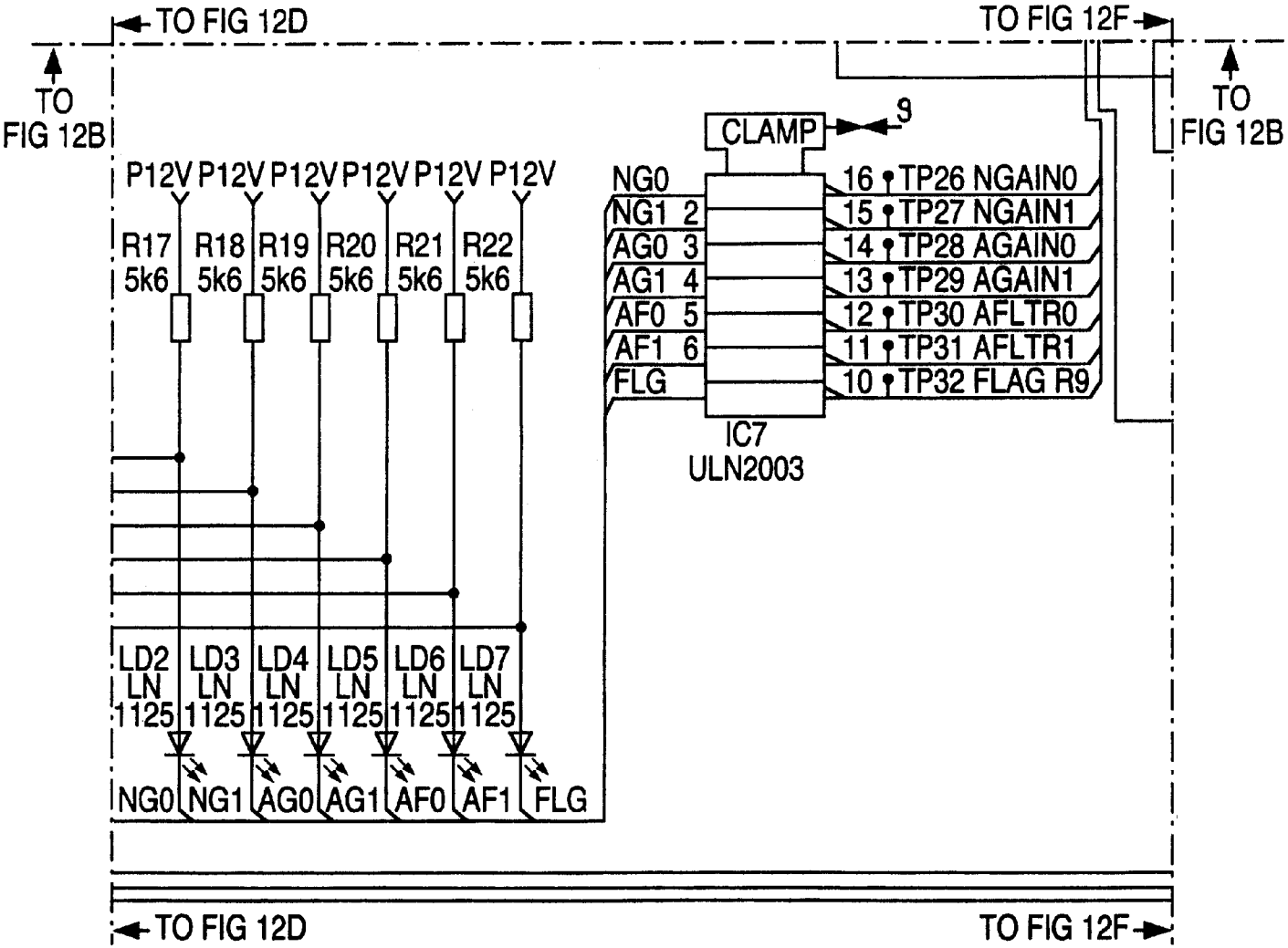
Figure 12F:
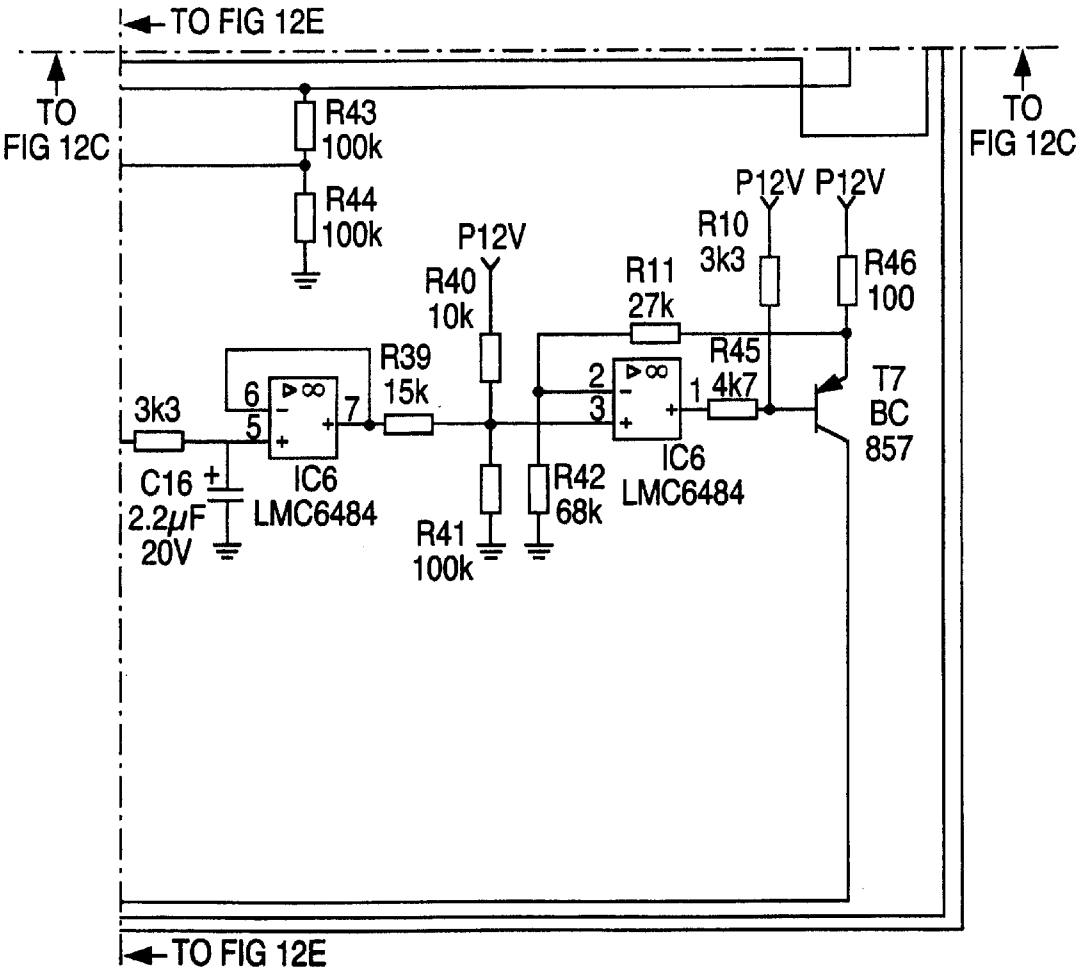

The photo transistor 8 is coupled to the electronic circuit illustrated in FIG. 8, and the photo transistor 9 is coupled to the electronic circuit illustrated in FIG. 9, while the LED 7 is coupled to the circuit illustrated in FIG. 10. The circuit illustrated in FIG. 11 serves for powering the circuits in FIGS. 8–10. The electronic circuits in FIGS. 8 and 9 substantially serve for filtering and amplifying the signals from the photo transistors 1 and 2. The outputs from the circuits in FIGS. 8 and 9 are coupled to inputs in the evaluator circuit illustrated in FIG. 12, whose CPU is programmed to treat the signals from the circuits in FIGS. 8 and 9 in absolute values. The circuit in FIG. 8 is easy to realise for a person skilled in the art with the guidance of the component values included in the diagram. The illumination by means of the LED 7 is pulsed for generating a carrier value of average amplitude, which is modified on change of the reflection because of a weft. The weft may increase the reflection to the first photo transistor 8 and reduce the reflection to the other photo transistor 9, or vice versa.

As a result of the treatment of the signals from the photo transistors 8 and 9 in absolute values, the device according to the present invention will be insensitive to negative reflection changes in the reed channel, which implies that a change of the reflection from the reed channel is added regardless of whether the reflection is reduced or increased on the occurrence of a weft. In this manner, the device according to the present invention will be substantially insensitive to wefts of different colors and structures and, in other words, solves the problems in those cases when the color and structure of the thread do not entail any major change of the reflection. However, it has proved that the light-sensitive elements 8 and 9 according to the present invention give sufficient signals for the evaluator circuit in FIG. 12. This circuit may be realised by a person skilled in the art with the guidance of the circuit diagram and the component values which may be read therefrom. The various inputs and outputs with the same designation are to be interconnected (e.g. ˆP12V and VP12V). The points TP1, etc., are test points.

Many modifications of the present invention described in the foregoing are naturally possible without departing from the scope of the invention.

What is claimed is:

1. A device for monitoring a weft thread in a loom of the type in which the weft is driven through the shed of the loom with the aid of a gas jet and which has a reed with a longitudinal channel for the weft, said device comprising:

a light source adapted for illuminating a monitoring position in the channel to monitor the weft at the monitoring position;

a plurality of light-sensitive elements, each light-sensitive element adapted to be aimed from a uniquely associated direction toward the monitoring position to sense light reflected therefrom, each light-sensitive element generating an electrical signal indicative of light sensed by such element, an evaluator circuit for adding the electrical signals from said light-sensitive elements to provide a signal corresponding to the sum of the absolute values of the electrical signals.

2. A device as claimed in claim 1, wherein said light source is a pulsed light source for generating a carrier wave having an average amplitude representing the reflection of light from the reed channel.

3. A device as claimed in claim 1, wherein said light source and said light-sensitive elements are adapted to be substantially focused on a line extending transversely of the reed channel.

4. A device as claimed in claim 1, wherein said evaluator circuit includes an evaluation channel for each light-sensitive element, and electronic circuit elements programmed to treat the signals from said evaluation channels in absolute value.

5. A device as claimed in claim 1, further comprising an arm having a free end with said light source and said light-sensitive elements thereon.

6. A loom apparatus, comprising:

a loom having a shed and a reed with a longitudinal channel for a weft;

a gas jet for driving the weft through the shed of said loom;

a light source for illuminating a monitoring position in the channel to monitor the weft at the monitoring position;

a plurality of light-sensitive elements, each light-sensitive element being aimed from a uniquely associated direction toward the monitoring position to sense light reflected therefrom, each light-sensitive element generating an electrical signal indicative of light sensed by such element; and an evaluator for adding the electrical signals from said light-sensitive elements to provide a signal corresponding to the sum of the absolute values of the electrical signals.

7. A loom apparatus as claimed in claim 6, wherein said light source is a pulsed light source for generating a carrier wave having an average amplitude representing the reflection of light from the reed channel.

8. A loom apparatus as claimed in claim 6, wherein said light source and said light-sensitive elements are substantially focused on a line extending transversely of the reed channel.

9. A loom apparatus as claimed in claim 6, wherein said evaluator circuit includes an evaluation channel for each light-sensitive element, said electronic circuit elements programmed to treat the signals from said evaluation channels in absolute value.

10. A loom apparatus as claimed in claim 6, further comprising an arm having a free end with said light source and said light sensitive element thereon.

* * * * *